United States Patent [19]

Thurner

[11] Patent Number: 4,721,150

[45] Date of Patent: Jan. 26, 1988

[54] DEVICE FOR SUPPLYING SPRAY UNITS FOR DIE CASTING MACHINES WITH A FLUID CONTAINING WATER AND ADDITIVES

[75] Inventor: Helmut Thurner, Schwaberwegen, Fed. Rep. of Germany

[73] Assignee: Bayrisches Druckgusswerk Thurner GmbH & Co. KG, Markt Schwaben, Fed. Rep. of Germany

[21] Appl. No.: 878,972

[22] PCT Filed: Dec. 4, 1985

[86] PCT No.: PCT/EP85/00666

§ 371 Date: Jun. 6, 1986

§ 102(e) Date: Jun. 6, 1986

[87] PCT Pub. No.: WO86/03438

PCT Pub. Date: Jun. 19, 1986

[30] Foreign Application Priority Data

Dec. 4, 1984 [DE] Fed. Rep. of Germany ..... 3444182

[51] Int. Cl.[4] ..... B22C 3/00; F04B 41/00

[52] U.S. Cl. ..... 164/267; 164/72; 239/304; 137/566

[58] Field of Search ..... 164/267, 72, 284, 303; 239/304, 307, 310; 222/145; 137/566, 567, 568

[56] References Cited

U.S. PATENT DOCUMENTS

| | | | |
|---|---|---|---|
| 2,587,722 | 3/1952 | Garrett et al. | 239/304 X |
| 3,421,694 | 1/1969 | Muller | 239/304 X |
| 4,186,769 | 2/1980 | Buyer | 137/566 |

FOREIGN PATENT DOCUMENTS

| | | |
|---|---|---|
| 2549059 | 2/1977 | Fed. Rep. of Germany . |
| 436591 | 11/1967 | Switzerland . |

*Primary Examiner*—Kuang Y. Lin

*Attorney, Agent, or Firm*—Dennison, Meserole, Pollack & Scheiner

[57] ABSTRACT

The subject matter of the invention is a device for supplying spray units for die casting machines each with a fluid containing water and additives for cooling, cleansing and lubricating purposes. The device contains at least one central tank (26,28) storing water comprising additives, whose concentration has been adjusted to a maximum. Said maximum value depends on casting materials, molds (18,20) and die casting methods which are carried out on the die casting machines (10,12). In another central tank (44) water is stored. The tanks (26,28,44) are connected to mixing valves (38,40) provided at each die casting machine (10,12). A pump is connected between the outlet of each mixing valve and the inlet of a respective spray unit at a die casting machine.

16 Claims, 4 Drawing Figures

DEVICE FOR SUPPLYING SPRAY UNITS FOR DIE CASTING MACHINES WITH A FLUID CONTAINING WATER AND ADDITIVES

BACKGROUND OF THE INVENTION

The invention relates to a device for supplying spray units for die casting machines with a fluid containing water and additives for cooling, cleansing and/or lubricating purposes.

During die casting processes the opened mold's interior is wetted with a fluid containing dissolved, suspended or emulsified additives prior to casting. The fluid is used for separating, cooling and/or lubricating. The composition of the fluid is contingent upon the material and the shape of the castings, above all upon their wall thicknesses as well as upon the conditions for a rapid and simple removal from the mold. The fluid is sprayed by spray units onto the walls of the mold. It is prior art to connect a spray unit arranged at a die casting machine with a tank from which the fluid is delivered by means of compressed air to the dies of the spray unit (Praxis der Druckgiessfertigung von E. Brunhuber, 1980, Fachverlag Schiele & Schön GmbH, on page 128).

Frequently, for diverse molds fluids having differing compositions and spray units adjusted to the respective mold are required. If at changing the mold the fluid supply in the tank is not exhausted, the tank must be emptied and filled with a mixture harmonized with the other mold. Moreover, it may also happen that the tank's capacity does not suffice for a major series of the same mold. Then, the die casting procedure must be interrupted at exhaustion of the fluid supply during automatic operation.

SUMMARY OF THE INVENTION

It is the object of the invention to create a device suited for automatic operation for supplying one or several spray units for die casting machines with each a fluid containing water and additives for cooling, cleansing and/or lubricating purposes.

According to the invention the above problem is solved by utilizing a device for supplying a plurality of spray units, each for a die casting machine, which comprises at least one first central tank for storing water containing additives of a concentration being the maximum necessary of the particular materials, molds and methods used, a further central tank for storing water, a mixing valve having a first inlet connected to the first central tank and a second inlet connected to the further central tank, an outlet, and means for adjusting the proportion of liquid from the first and further central tanks delivered through the outlet, and a pump for each spray unit having an inlet connected to the outlet of a respective mixing valve, and an outlet connected to a spray unit. The device as described makes an adjustment of the desired mixing ratio by the mixing valve at the respective die casting machine possible. Then, only the amount of fluid especially tailored to the respective mold is produced according to the necessity of the individual spraying procedure. At changing the molds nothing but the adjustment of the mixing valve must be altered if a new mixing ratio is required. Such adjustment takes only short time. The process of production is, therefore, no longer affected by the time-consuming re-filling or exchanging of the fluid for the spraying step. By the device described herein better use may be made of the die casting machines as there are less setting periods. It is the principle of present invention to store fluids having the highest concentration necessary and for making the dilution with water required for each casting step prior to spraying.

DESCRIPTION OF THE PREFERRED EMBODIMENTS

A preferred example of embodiment provides a number of central tanks corresponding to the type of casting materials to be treated in the die casting machines, in which fluids each of water and additives are stored in the highest concentration required for the respective casting material with a corresponding mold, the central tanks being coupled through reversing valves to a piping system to which the mixing valves are connected. At a change of the type of die casting material to be processed, e.g. when changing from aluminum over to zinc die casting, on one or several of the die casting machines centrally supplied with spray fluid the change-over to the suited spray fluid is brought about by opening the valve between the collecting pipe and the central tank provided for the respective material as well as by bringing the mixing valve adjustment into line with the material and the mold used. The change of the spray fluid is rapid and simple.

Preferredly, the central tanks are arranged higher than then die casting machines. It is, thus, under the action of gravity that the fluids from the tanks reach the mixing valves. This is why expensive and energy-consuming conveying means are rendered superfluous.

It is expedient to connect to the outlet of each mixing valve a pump which feeds the spray unit for the die casting machine. By the aid of a pump the amount of fluid to be sprayed can be adjusted exactly to the respective need. This results in an economic consumption of spray fluid.

Another preferred embodiment is to form the pump as a plunger pump, whose cylinder either is vertically disposed or may take any other position whatsoever, when it is guaranteed that gravity plays its necessary part through the media. In case of said example of embodiment for the supplying and mixing of the respective fluids up to the filling of the cylinder's interior with the mixture no pump is necessary. Said procedures are carried out under the action of gravity, and for this reason the said device operates particularly economically.

Preferably, the plunger of the respective plunger pump shows two spaced disks, one of which faces the cylinder volume designed to receive the fluid and the other of which faces the cylinder volume attackable by pressure gas, by which the interspace defined by said two disks can be connected via a check valve at relief of the excess pressure. With said device fluid penetrating the interspace while the the cylinder volume filled with fluid is being pumped down, may enter into the cylinder volume no longer under gas pressure after termination of the pumping step and escape therefrom. By the plunger composed of two disks the problem of sealing against the fluid and against the pressure gas is solved in a simple way.

The cylinder volume attackable by pressure gas is most suitably apt to be connected by a reversing valve to the source of compressed air provided for the spray unit. To actuate the pump and the spray unit one may use the same source of compressed air.

At an advantageous embodiment a check valve is arranged at the outlet of the cylinder volume attackable by fluid. The pump may be positioned at a suitable place below the spray unit. The check valve prevents that fluid flows back from the spray unit to the pump resp. that the spray unit gives off drops.

An advantageous embodiment of a mixing valve resides in that a cylindrical body rotatably mounted in a casing has a concentric cavity open towards one side and a radial slot which may be turned around as against two inlet openings in a casing wall for the fluid and for water by countercurrent change of the inlet cross-sections, check valves being introduced before the inlet openings. At pumping down the cylinder the check valves prevent a flow-back of the fluid contained in the cylinder into the central tanks. The cylindrical body may be provided with a lever whose one end is formed as an indicating tip for a scale. The said embodiment renders the manual adjustment of the mixing ratio possible. But the cylindrical body may also be provided with a motor drive and the angle position of the cylindrical body may be detected by a position-indicating means, as well. A potentiometer giving an analog indication or a coding disk by which the position may be detected digitally are suitable position-indicating means. A geared motor can be used as a motor drive.

Preferably, the cylinder of the pumps is composed of two disks and a cylindrical jacket arranged between the disks. Said embodiment can be produced economically. A relatively thin-walled cylindrical jacket suffices. To limit the travel of plunger stops may be provided in the cylinder. By an adjustment of the stops the suction volume of the cylinder and, hence, the amount of the fluid to be sprayed can be pregiven.

Other particulars, features and advantages of the invention are resultant from the following description of an illustrated example of embodiment.

Figure 1:
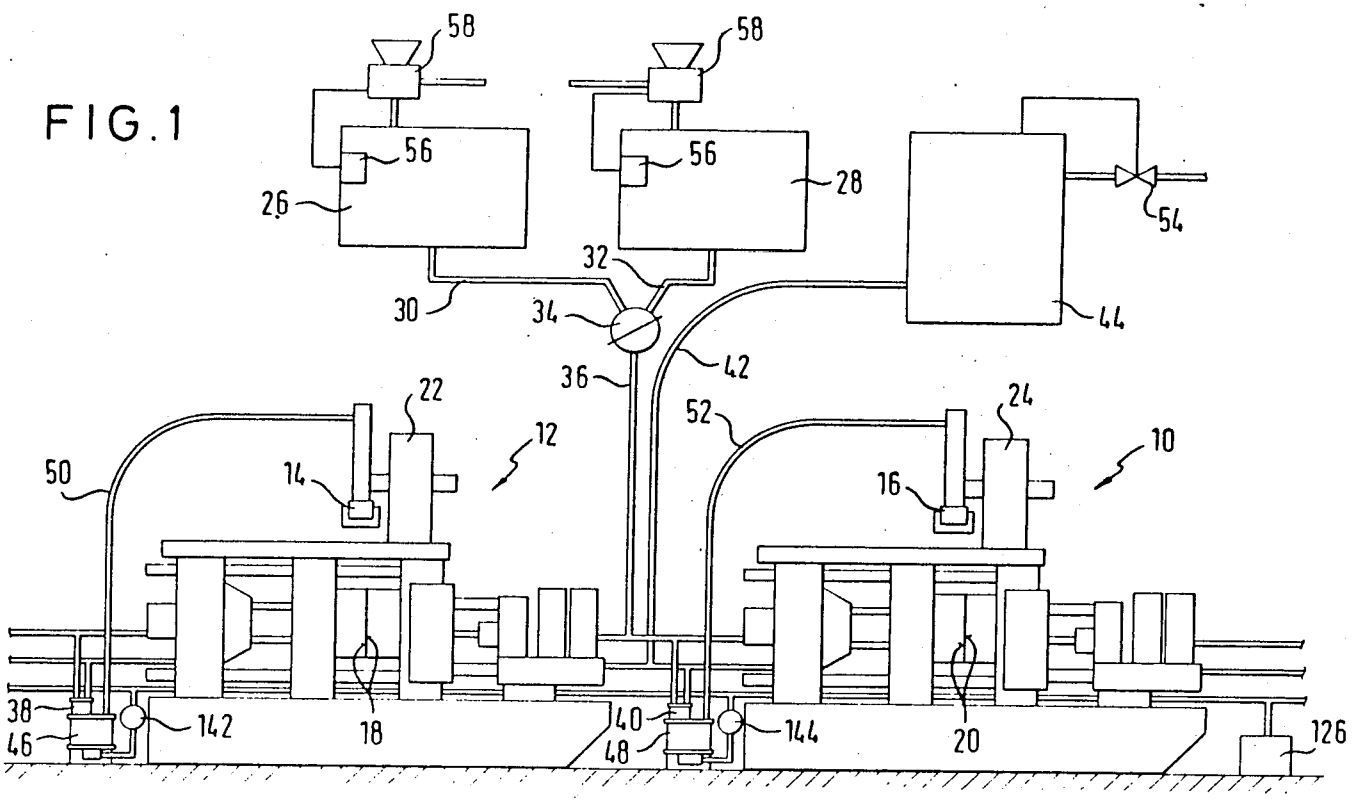
FIG. 1 shows a schematic view of a device for supplying spray units for die casting machines.

Die casting machines 10, 12, two of which are shown in FIG. 1, each have spray units 14,16 by which the surfaces of molds 18,20 each consisting of a stationary and a movable half are sprayed on. The two halves of molds 18,20 are not designated any closer. The two die casting machines each reveal a machine bed and posts arranged thereon. The stationary mold halves and hydraulic elements are fixed on said posts. The hydraulic elements move a sliding carriage and the movable mold half affixed thereto during the manufacture of the castings. The machine bed, the posts and the hydraulic elements are designated more particularly in FIG. 1.

The spray units 14,16 each spray a fluid for cooling, cleansing and/or lubricating purposes onto the mold surfaces. Spray units 14,16 are provided with spray nozzles adjustable as regards direction - not designated more closely and are mounted slidably and pivotally both horizontally and vertically on carriers 22,24. Carriers 22,24 each are disposed on one of the machine posts. The fluids to be sprayed consist of water containing additives which may be graphite, pigments or the like in conjunction with special active ingredients and carriers. In many cases emulsive pigment-free additives are used.

For different molds 18,20 and different casting materials fluids of different compositions are frequently needed. Spray units 14,16 often must be exchanged or adjusted anew under adaptation to another mold, as well.

To supply spray units 14,16 with fluids whose compositions are brought into line with the respective conditions of the production method applied on the die casting machine 10,12 a device having at least one tank 26 central as against spray units 14,16 is used. Tank 26 contains water and additives in the highest concentration necessary. Concentration is adjusted to that mold and that casting material which need the highest proportion of additives for making perfect castings. The additives may be diluted with water at e.g. a ratio of 1:50 or 1:80. If different additives are needed for different casting materials, e.g. aluminum or zinc die-casting, further central tanks containing fluids in which the corresponding additives are dissolved in the highest concentration necessary must be provided for. FIG. 1 shows only one additional central tank. If need be, several central tanks can be provided for.

On their outlet side the central tanks 26,28 are connected through pipings 30,32 with a reversing valve 34, whose outlet is coupled to a central piping system 36 which comprises departures—not designated any closer—extending to die casting machines 10,12 and further die casting machines not shown. At the die casting machines 10,12 and the other die casting machines there are mixing valves 38,40, each of which is connected by one inlet to the piping system 36. Through a second inlet each the mixing valves 38,40 are connected to a piping system 42 which is fed by central tank 44 containing water. Central tanks 26,28,44 are at one level above die casting machines 10,12. This is why water from tank 4 4 and the fluid selected each thrgugh reversing valve 34 reach the mixing valves 38,40 at the die casting machines 10,12 under the action of gravity and under substantially the same pressure. The concentration of the additives in water as necessitated for the respective process of production is produced by admixing water from tank 44 in the adjustable mixing valves 38,40.

To mixing valves 38,40 pumps 46,48 each are subsequented which are arranged e.g. at the level of the machine bed of the respective die casting machine 10,12. On the outlet side pumps 46,48 each are coupled to spray units 14,16 via pipings 50,52. Pipings 30,32, reversing valve 34, piping system 36, mixing values 38,40, piping system 42, tank 44 and pumps 46,48 and tanks 26,28 are part of the device by which the die casting machines 10,12 are supplied centrally and automatically each with a fluid containing water and additives in a concentration adjustable at the mixing valves 38,40.

To control the water level in tank 44 said tank 44 is provided with a means 54. If the water level goes under a defined level, this will be detected by a level sensor which is part of means 54. Said level sensor opens a tap within a pipe fed by the water piping system to tank 44 till the desired level is reached.

Tanks 26 and 28 have also level sensors 56 which control dosing means 58. Said dosing means 58 produce the fluids determined for tanks 26,28 from the additives and the water fed.

Figure 2:
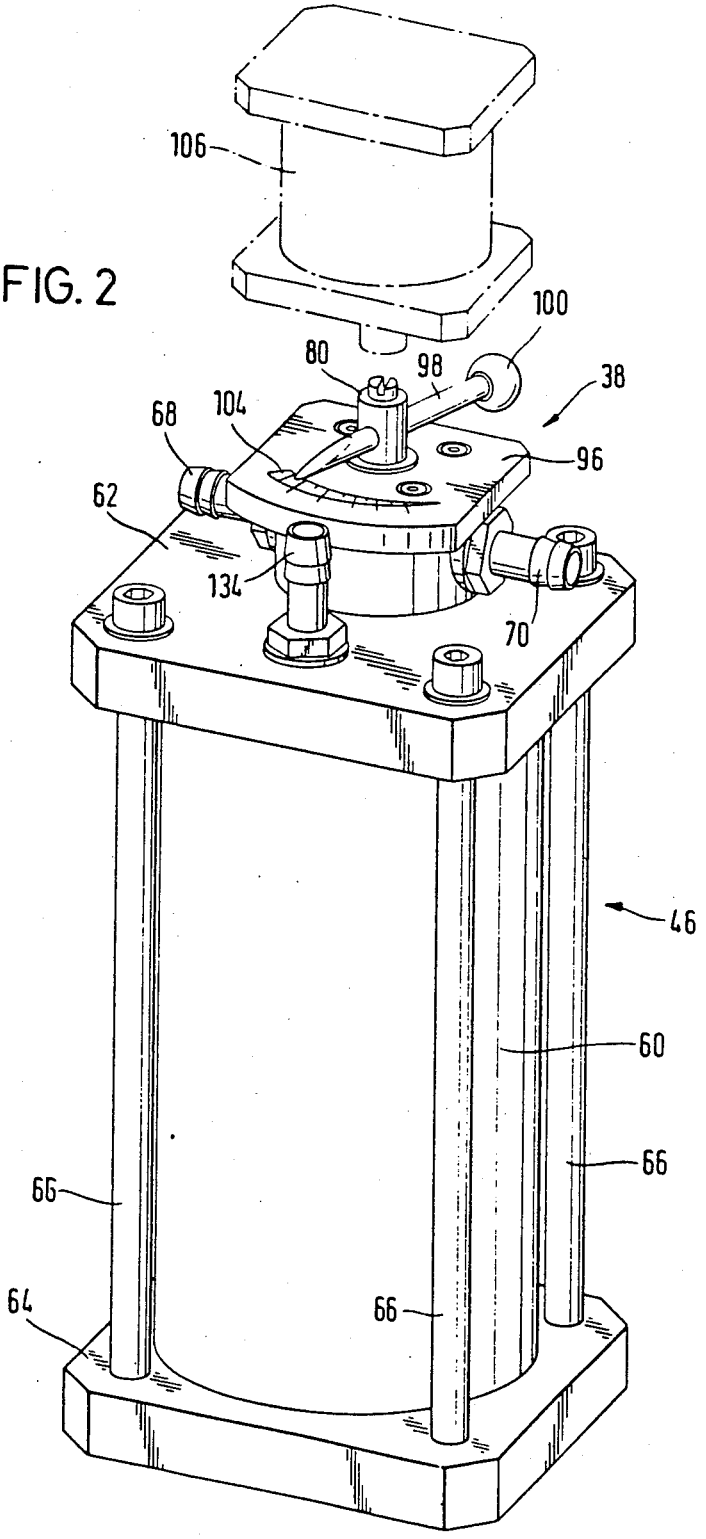
FIG. 2 is a perspective view of a mixing valve and a pump of the device shown in FIG. 1.
Figure 4:
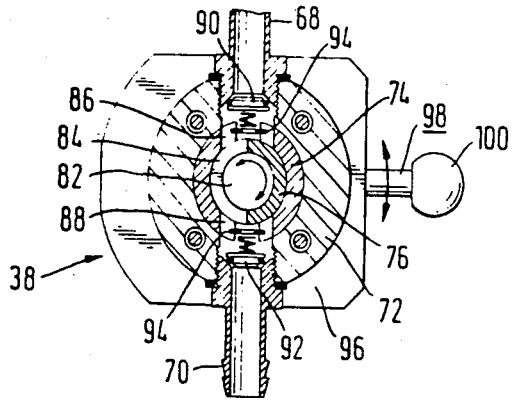
FIG. 4 is a cross-section along lines III—III of the device shown in FIG. 3.
Figure 3:
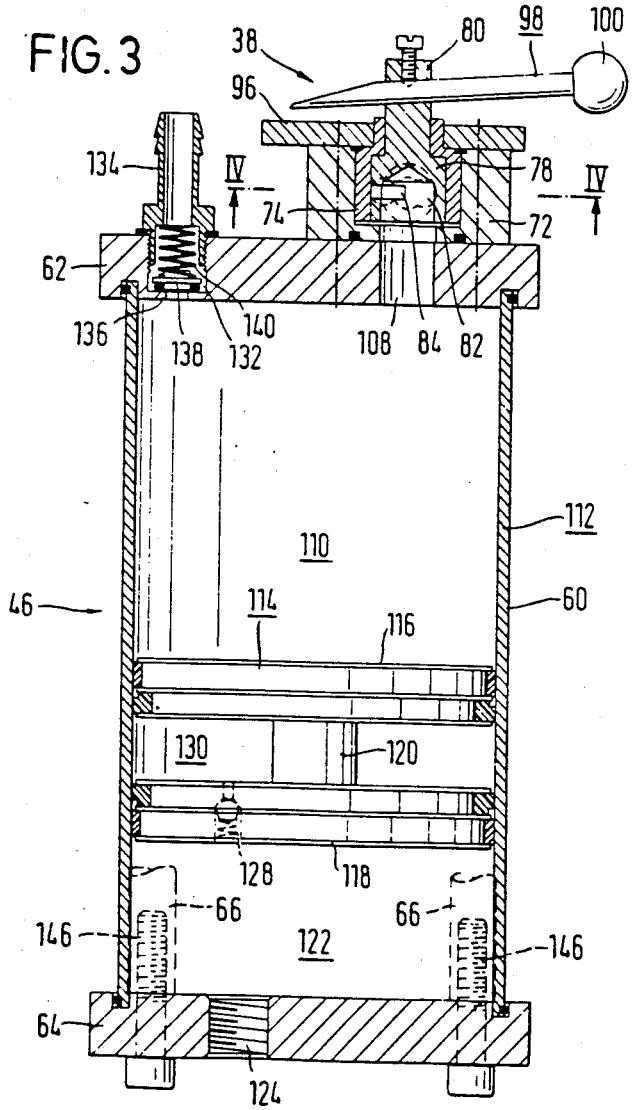
FIG. 3 is a longitudinal section through the device illustrated by FIG. 2.

Pumps 46,48, one of which is illustrated as a perspective view in FIG. 2 and IN CROSS SECTION IN FIG. 3, each have a cylindrical jacket 60 which is held between an upper disk 62 and a lower disk 64 by using sealings not designated more detailedly. Disks 62,64 are of rectangular shape. Disks 62,64 are connected by stay bolts 66 at the four angles. Pumps 46,48 stand with their cylinders at die casting machines 12,10. To the upper disk 62 each the mixing valve 38 resp. 40 is fixed.

Mixing valves 38,40 are provided with each a connecting member 68 for the fluid supplied by tanks 26 or 28 and with a connecting member 70 for water supplied from tank 44. In a cylindrical casing 72 or the mixing valves 38,40 a bearing 74 in which a cylindrical body 76 is rotatably mounted is fixed. Cylindrical body 76 consists of two section 78,80 having differing diameters. Section 78 having the larger diameter shows a cylindrical recess 82 which is open towards the side of mixing valve 38 resp. 40 facing pump 46,48. In section 78 there is slot 84 extending over the entire half of the circular ring of the wall surrounding recess 82. At the level of slot 84 on diametrically opposite positions of casing 72 and bearing 74 there are each cylindrical recesses 86,88 for the inlet of water and fluid. Recesses 86, 88 are each connected with the cavities of connecting members 68,70—the cavities not being designated any closer—which are screwed into casing 72. Dependent upon the adjustment of angle of the slot 84 as against recesses 86,88 the mixing ratio of the fluid arriving through connecting member 68 and the water arriving at connecting member 70 may be modified. Between one position each of slot 84, in which either the recess 86 resp. 88 is completely closed or the the recess 88 resp. 86 is open towards recess 82, and other positions of slot 84 differing cross-sections of aperture which determine the respective mixing ratio are achieved.

The front sides of connecting members 68,70 which lie within the interior of casing 72 and are not designated any closer are formed as valve seats for valve disks 90,92 which are spring-loaded against the valve seats. Valve disks 90,92, the valve seats and the springs not designated with more detail, whose ends are supported by valve disks 90,92 and spring rings 94 in recesses 86,88 are check valves.

On its side averted from pump 46 resp. 48 the casing 72 is closed by a plate-shaped cover 96 having an aperture—not designated any closer—through which section 80 of body 76 projects outwardly. In a bore extending approximately radially in section 80 a lever 98 is inserted and then clamped with a screw. Lever 98 projects from both sides of section 80. One end 100 of lever 98 is knobbed, while the other end of lever 98 is formed as a pointer 102 which is rotatable above scale 104 from which the mixing ratio may be taken. Through lever 98 the position of angle of slot 84 may be brought manually into harmony with a desired mixing ratio.

In place of lever 98 or in addition to lever 98 the shaft of motor 106, e.g. of a geared motor, may be connected to section 80. Motor 106 is dash-dotted above the front side of section 80 in FIG. 2. By motor 106 slot 84 may be adjusted by distant control to the desired angle position. To report the angle position of slot 84 e.g. a rotary or angle potentiometer 81 which at the tap gives a potential dependent on the angle position and being detected by a central control may be used. By the aid of the rotary potentiometer, whose output signal is centrally detected, and motor 106 which is centrally supplied with control potential an automatic adjustment of the mixing ratio to values pre-given by e.g. a programmable control device can be achieved.

Casing 72 of mixing valve 38 resp. 40 is fixed to disk 62 of pump 46 resp. 48 such that the recess 82 is in alignment with an inlet 108 in disk 62. Inlet 108 opens out into cylinder volume 110 within the cylinder formed by disks 62, 64 and jacket 60, wherein plunger 114 is movably arranged. Plunger 114 contains two spaced plunger disks 116,118 connected by centric tappet 120. Under disk 118 there is cylinder volume 122 apt to be connected by bore 124 with a source of compressed air 126 which also feeds spray units 14,16. In plunger disk 118 there is check valve 128 by which the interspace 130 confined by plunger disks 116,118 can be connected with cylinder volume 122, if there is no excess pressure in cylinder volume 122.

The cylinder volume has an outlet opening 132 arranged in disk 62, a connecting member 134 being screwed into it. At the end facing the cylinder volume 110 the outlet opening 132 has an annular projection 136 against which cover 138 is sealingly pressed under spring-load. Spring 140 is supported by a shoulder in connecting member 134 and cover 138. Cover 138 forms a check valve with projection 136 and spring 140.

The fluid provided with the additives in the highest concentration necessary comes from tanks 26 and 28 via pipes 30,32 to reversing valve 34 selecting tank 26 or 28. The adjustment of reversing valve 34 determines the connection of tank 26 or 28 to piping system 36 most suitably having an outlet tap by which prior to a switchover to another tank the fluid still contained in the piping system can be removed. Through piping system 36 fluid reaches connecting members 68 of mixing valves 38,40. From tank 44 water enters via piping system 42 into connecting members 70 of the mixing valves 38,40. By the action of gravity of the fluid resp. of the water valve disks 90,92 are opened and, thus, fluid and water reach body 76 each via recesses 86 and 88. Through the free cross-section—dependent on the position of angle of slot 84—at the orifice of recess 86 resp. 88 each fluid and water enter into slot 84. Fluid and water mix in slot 84 and recess 82. Via inlet 108 the mixture comes into cylinder volume 110 filling with fluid mixture whose mixing ratio depends on the position of angle of slot 84. Dependent upon the production program for which the die casting machines 10,12 are equipped the positions of angle of slots 84 differ in mixing valves 38,40.

Between source 126 of compressed air and bores 124 there are reversing valves 142,144 each, which may be operated manually or by some control. In the idle position of plunger 114 atmospheric pressure is applied to cylinder volume 122 through reversing valves 142,144. Here, plunger 114 lies close to stops 146 which are formed as screws and which are screwed into disk 64 and limit the travel of stroke of plunger 114. Via the travel of stroke the maximum cylinder volume 110 disposable for the fluid mixture is determined by the stops 146 and, thus, the fluid amount provided for spraying.

If cylinder volume 122 is under atmospheric pressure, the fluid having penetrated interspace 130 between plunger disk 116 and jacket 60 may reach cylinder volume 122 through check valve 128 and escape into the atmosphere.

If fluid is to be sprayed onto molds 18,20 the cylinder volumes 122 are connected each by reversing valves 142,144 to the source 126 of compressed air. At the same time spray units 14,16 are supplied by source of compressed air 126 with compressed air. At the compressed air's impinging on plunger 114 it is moved upwardly, a working pressure of e.g. 7 bar being generated in cylinder volume 110. The check valves in mixing valves 38,40 close under the pressure in the working space such that no fluid is pumped back from the cylinder volume 110 into tanks 26,28,44. The fluid each leaves cylinder volume 110 via outlet opening 132 and comes into pipings 50 resp. 52 extending to spray units 14,16.

When plunger 114 has displaced the fluid from the cylinder 112, an atmospheric pressure is applied to the cylinder volume 122 by reversing valves 142,144, which may be electromagnetically operable control valves, as well. By the pressure discharge of plunger 114 the check valve constituted of elements 136,138,140 closes, the return of fluid from the spray units 14,16 and the pipings 50,52 being prevented. This check valve is adjusted so as to close already at drop of the pressure to 2 bar in the cylinder volume 110. At the same time, this prevents most advantageously an after-dropping at the spray units 14,16, and thus no undesired influence on the surface of the open mold 18,20 by dropping may make itself felt. Pumps 46,48 are arranged at a level lower than that of spray units 14,16.

Plunger 114 which may be formed from one piece has a certain axial expansion so that the exertion of low pressure is sufficient to actuate plunger 114. When fluid comes into interspace 130, it is removed through the check valve 128. This guarantees a uniform faultless mode of working of plunger 114. As it is worked at low pressure in cylinder 112, the jacket 60 may have a thin wall.

Owing to the level control the central tanks 26,28,44 may be given small volumes. In place of tank 44 having level control the feeding may also be carried out by the water main, a pressure-reducing valve adjusting the pressure to the pressure at the mixing values 38,40, which is dependent on the height of mounting of tanks 26,28.

What is claimed is:

1. A device for supplying a plurality of spray units, each for a die casting machine, with a fluid containing water and additives for cooling, cleansing and/or lubricating, comprising:

at least one first central tank for storing water containing additives, the concentration of the additives being the maximum necessary for the casting materials, molds, and methods utilized in conjunction with the die casting machine;

a further central tank for storing water;

a mixing valve for each spray unit having a first inlet connected to said at least one first central tank and a second inlet connected to said further central tank, an outlet, and means for adjusting the proportion of liquid from said at least one first central tank and said further central tank delivered through said outlet; and a pump for each spray unit having an inlet connected to the outlet of a respective mixing valve, and an outlet connected to the respective spray unit.

2. The device of claim 1, wherein a plurality of first central tanks is provided, the number of first central tanks corresponding to the types of materials to be processed in the die casting machines, and wherein each said first central tank is connected to a reversing valve having an outlet connected to said mixing valves, said reversing valve including means to selectively connect said mixing valves to one said first central tank.

3. The device according to claim 1, wherein each said mixing valve comprises a casing (72) having a cylindrical body (76) rotatably mounted therein, said body having a hollow central portion (82) and a radial slot in its surface over a circumferential portion thereof, said slot communicating with the hollow central portion, said casing having a first inlet opening communicating with said first inlet via a first check valve, and a second inlet opening communication with said second inlet via a second check valve, said slot being adjustably positionable opposite said first and second inlet openings, and said hollow central portion being in communication at one end to said pump outlet.

4. The device according to claim 1 or 2, wherein the central tanks (26,28,44) are arranged at a higher level than the die casting machines (10,12).

5. The device according to claim 4, wherein the central tanks (26,28,44) ar arranged at the same level .

6. The device according to claim 1, wherein the pumps (46,48) are formed as plunger pumps cylinders (112) .

7. The device according to claim 6, wherein each plunger pump includes a plunger (114) having two spaced disks (116,118), one of which faces a first cylinder volume (110) connected to the pump inlet and outlet, and defined to receive the fluid being pumped, and the other of which faces a second cylinder volume (122) defined to receive a pressurized gas, an interspace (130) between said two disks (116,118) being connected to the atmosphere via a check valve (128) for relief of the excess pressure.

8. The device according to claim 7, wherein the second cylinder volume (122) is connected through a reversing valve (142,144) with a source of compressed gas (126) provided for the pumps.

9. The device according to claim 7, wherein a check valve (136,138,140) is arranged between the pump outlet and the first cylinder volume (110).

10. The device according to claim 2, wherein said cylindrical body (76) has a section (80) projecting from casing (72), a lever (98) being affixed to said section.

11. The device according to claim 10, wherein a motor (106) is connected with said section (80) projecting from said casing (72).

12. The device according to claim 10, wherein the section (80) projecting from said casing (72) is connected with an angle potentiometer.

13. The device according to claim 6, wherein the cylinder (112) of the each pump (46,48) comprises two disks (62,64) and a cylindrical jacket (60) arranged between the disks (62,64).

14. The device according to claim 1, wherein the central tanks include fluid level controllers.

15. The device according to claim 7, wherein said second cylinder volume (112)

has in a communication therewith a valve (142,144) for ventilation to the atmosphere.

16. The device according to claim 12, wherein the cylinder (112) includes a movable plunger (114) and adjustable stops (146) which control the length of movement of the plunger.

* * * * *